US010661316B2

(12) United States Patent
Pham et al.

(10) Patent No.: US 10,661,316 B2
(45) Date of Patent: May 26, 2020

(54) OILFIELD MATERIAL METERING GATE OBSTRUCTION REMOVAL SYSTEM

(75) Inventors: Hau Nguyen-Phuc Pham, Houston, TX (US); Miguel Lopez, Houston, TX (US); Laurent Coquilleau, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 865 days.

(21) Appl. No.: 13/480,946

(22) Filed: May 25, 2012

(65) Prior Publication Data

US 2012/0298210 A1 Nov. 29, 2012

Related U.S. Application Data

(60) Provisional application No. 61/490,708, filed on May 27, 2011.

(51) Int. Cl.
*B08B 9/093* (2006.01)

(52) U.S. Cl.
CPC ..... *B08B 9/093* (2013.01); *Y10T 137/0419* (2015.04); *Y10T 137/4245* (2015.04)

(58) Field of Classification Search
CPC ..... B08B 9/093; Y10T 137/0419; Y10T 137/4245
USPC ..... 239/398, 429, 668; 137/15.04, 238; 222/567
See application file for complete search history.

(56) References Cited

U.S. PATENT DOCUMENTS 3,285,522 A * 11/1966 Salisbury ..... B01F 5/0403 239/10
3,424,352 A * 1/1969 Schlink ..... B61D 5/004 137/860
3,926,377 A * 12/1975 Johnson ..... 239/655
3,957,209 A * 5/1976 Thomson ..... B01F 5/205 239/429
4,325,495 A * 4/1982 Mokris ..... B65D 88/703 222/1
4,413,758 A * 11/1983 Walters ..... B65G 53/22 222/195
5,320,280 A * 6/1994 Murphy ..... B05B 7/24 137/885
5,931,393 A * 8/1999 Alsip ..... E01C 19/205 239/654
6,027,038 A * 2/2000 Frankoski et al. ..... 239/142
6,939,031 B2 9/2005 Pham et al.
7,258,522 B2 8/2007 Pham et al.
7,740,447 B2 6/2010 Pessin et al.
8,419,266 B2 4/2013 Velayutham et al.
8,506,267 B2 8/2013 Gambier et al.
(Continued)

FOREIGN PATENT DOCUMENTS

FR 2770426 * 5/1999 ..... B08B 5/02
WO 2012052842 A2 4/2012
WO 2012166590 A1 12/2012

*Primary Examiner* — Cody J Lieuwen
*Assistant Examiner* — Qingzhang Zhou
(74) *Attorney, Agent, or Firm* — Cathy Hewitt

(57) ABSTRACT

A system is disclosed. The system is provided with an oilfield material reservoir, a fluid nozzle, and a fluid supplier. The oilfield material reservoir is provided with an opening for receiving an oilfield material and an orifice for discharging the oilfield material. The fluid nozzle is positioned adjacent to the orifice to direct a fluid flow through the orifice, and the fluid supplier is connected to the fluid nozzle.

6 Claims, 7 Drawing Sheets

(56) References Cited

U.S. PATENT DOCUMENTS

| | | | | |
|---|---|---|---|---|
| 2004/0003842 | A1* | 1/2004 | DeCourcy | B08B 5/02 137/68.23 |
| 2006/0081289 | A1* | 4/2006 | Musselman et al. | 137/120 |
| 2007/0295509 | A1 | 12/2007 | Pessin et al. | |
| 2008/0298163 | A1 | 12/2008 | Pessin et al. | |
| 2009/0257303 | A1 | 10/2009 | Rayner et al. | |
| 2010/0071899 | A1 | 3/2010 | Coquilleau et al. | |
| 2011/0085924 | A1 | 4/2011 | Shampine et al. | |

* cited by examiner

OILFIELD MATERIAL METERING GATE OBSTRUCTION REMOVAL SYSTEM

CROSS-REFERENCE TO RELATED APPLICATIONS

The present application claims priority to the provisional patent application identified by U.S. Ser. No. 61/490,708 filed on May 27, 2011, the entire content of which is hereby incorporated herein by reference.

TECHNICAL FIELD

Embodiments disclosed herein are generally related to systems, apparatus and/or methods of clearing obstructions within a metering system.

BACKGROUND

In hydraulic fracturing, fracturing fluid is injected into a wellbore, penetrating a subterranean formation and forcing the fracturing fluid at pressure to crack and fracture the strata or rock. Proppant is placed in the fracturing fluid and thereby placed within the fracture to form a proppant pack to prevent the fracture from closing when pressure is released, providing improved flow of recoverable fluids, i.e., oil, gas, or water. The success of a hydraulic fracturing treatment is related to the fracture conductivity which is the ability of fluids to flow from the formation through the proppant pack. In other words, the proppant pack or matrix must have a high permeability relative to the formation for fluid to flow with low resistance to the wellbore. Permeability of the proppant matrix may be increased through distribution of proppant and non-proppant materials within the fracture to increase porosity within the fracture.

Prior to injection of the fracturing fluid, the proppant and other components of the fracturing fluid must be blended. Gravity fed proppant addition systems may transfer proppant via gravity free fall to a mixer in order to be added to fracturing fluid. Metering the proppant volume in a gravity fed system may be calculated by determining the flow rate of the proppant through an orifice of a known size when the proppant is in gravity free fall through the orifice. Gravity fed systems may also employ the use of pressurization to aid in transferring proppants into the fluid stream or mixer. Pressurization methods in gravity fed systems may include pressurizing the proppant container subject to the gravity feed or utilizing a venture effect where a smaller diameter pipe is connected to a larger diameter pipe to draw the proppant from the proppant container into the mixer or fluid stream.

Moist, damp proppant is a serious problem that negatively affects the service quality of oilfield well fracturing and gravel packing operations. Existing slurry blending equipment typically relies on the use of proppant that is gravity fed through metering orifices of varying geometry whose openings are adjusted using a mechanical gate. These mechanical metering systems work optimally when proppant is dry and can flow freely. However, moist proppant does not flow in the same manner as dry proppant, and can interfere with the flow of dryer proppant to the point of completely blocking off proppant flow out of the metering gate in some situations, thus affecting the desired proppant concentration in the slurry and negatively affecting service quality of oilfield operations.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

According to one aspect of the present disclosure, at least one embodiment relates to a proppant metering gate obstruction removal system for clearing obstructions or clogs from a metered orifice.

In this aspect, the proppant metering gate obstruction removal system has an oilfield material reservoir, a fluid nozzle, and a fluid supplier. The oilfield material reservoir has an opening for receiving an oilfield material and a first orifice for discharging the oilfield material. The fluid nozzle is positioned adjacent to the first orifice, and may be comprised of a solid member. The fluid nozzle has a through hole, a first inlet, a second inlet, and a slot. The fluid nozzle may be mounted on the oilfield material reservoir in such a manner that the slot of the fluid nozzle corresponds to the first orifice for directing a fluid flow through the first orifice. The fluid supplier may be connected to the fluid nozzle by both the first inlet and the second inlet, and may be in fluid communication with the fluid nozzle and the oilfield material reservoir. The proppant metering gate obstruction removal system further comprises an automatic control unit that regulates at least one parameter of a fluid flow through the fluid nozzle.

According to another aspect of the present disclosure, at least one embodiment relates to a method for removing an obstruction or clog from the first orifice, where an electromechanical control valve, disposed between the fluid supplier and the fluid nozzle automatically controls, via the automatic control unit, at least one parameter of a fluid flow through the fluid nozzle.

However, many modifications are possible without materially departing from the teachings of this disclosure. Accordingly, such modifications are intended to be included within the scope of this disclosure as defined in the claims.

BRIEF DESCRIPTION OF THE DRAWINGS

Embodiments of systems, apparatus and/or methods of clearing obstructions within a metering system are described with reference to the following figures. The same numbers are used throughout the figures to reference like features and components. Implementations of various technologies will hereafter be described with reference to the accompanying drawings. However, it should be understood that the accompanying drawings illustrate the various implementations described herein and are not meant to limit the scope of various technologies described herein.

DETAILED DESCRIPTION

At the outset, it should be noted that in the development of any such actual embodiment, numerous implementation-specific decisions must be made to achieve the developer's specific goals, such as compliance with system related and business related constraints, which will vary from one implementation to another. Moreover, it will be appreciated that such a development effort might be complex and time consuming but would nevertheless be a routine undertaking for those of ordinary skill in the art having the benefit of this disclosure. In addition, the composition used/disclosed herein can also comprise some components other than those cited. In the Summary and this Detailed Description, each numerical value should be read once as modified by the term "about" (unless already expressly so modified), and then read again as not so modified unless otherwise indicated in context. Also, in the Summary and this Detailed Description, it should be understood that a concentration range listed or described as being useful, suitable, or the like, is intended that any and every concentration within the range, including the end points, is to be considered as having been stated. For example, "a range of from 1 to 10" is to be read as indicating each and every possible number along the continuum between about 1 and about 10. Thus, even if specific data points within the range, or even no data points within the range, are explicitly identified or refer to only a few specific, it is to be understood that inventors appreciate and understand that any and all data points within the range are to be considered to have been specified, and that inventors possessed knowledge of the entire range and all points within the range.

The statements made herein merely provide information related to the present disclosure and may not constitute prior art, and may describe some embodiments illustrating the invention.

Figure 1:
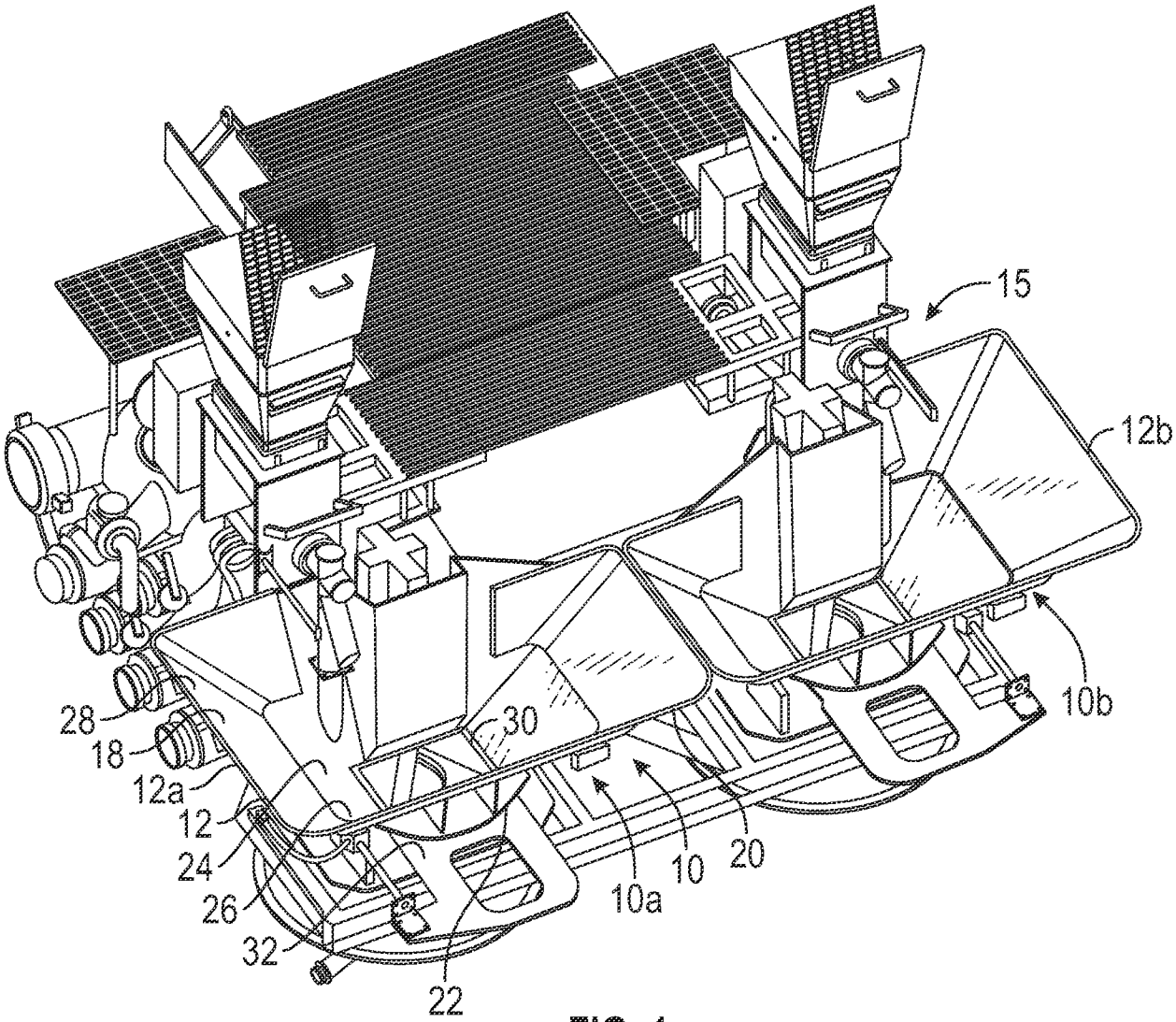
FIG. 1 illustrates a perspective view of a blending unit with two oilfield material metering gate obstruction removal systems constructed in accordance with implementations of various technologies and techniques described herein.
Figure 2:
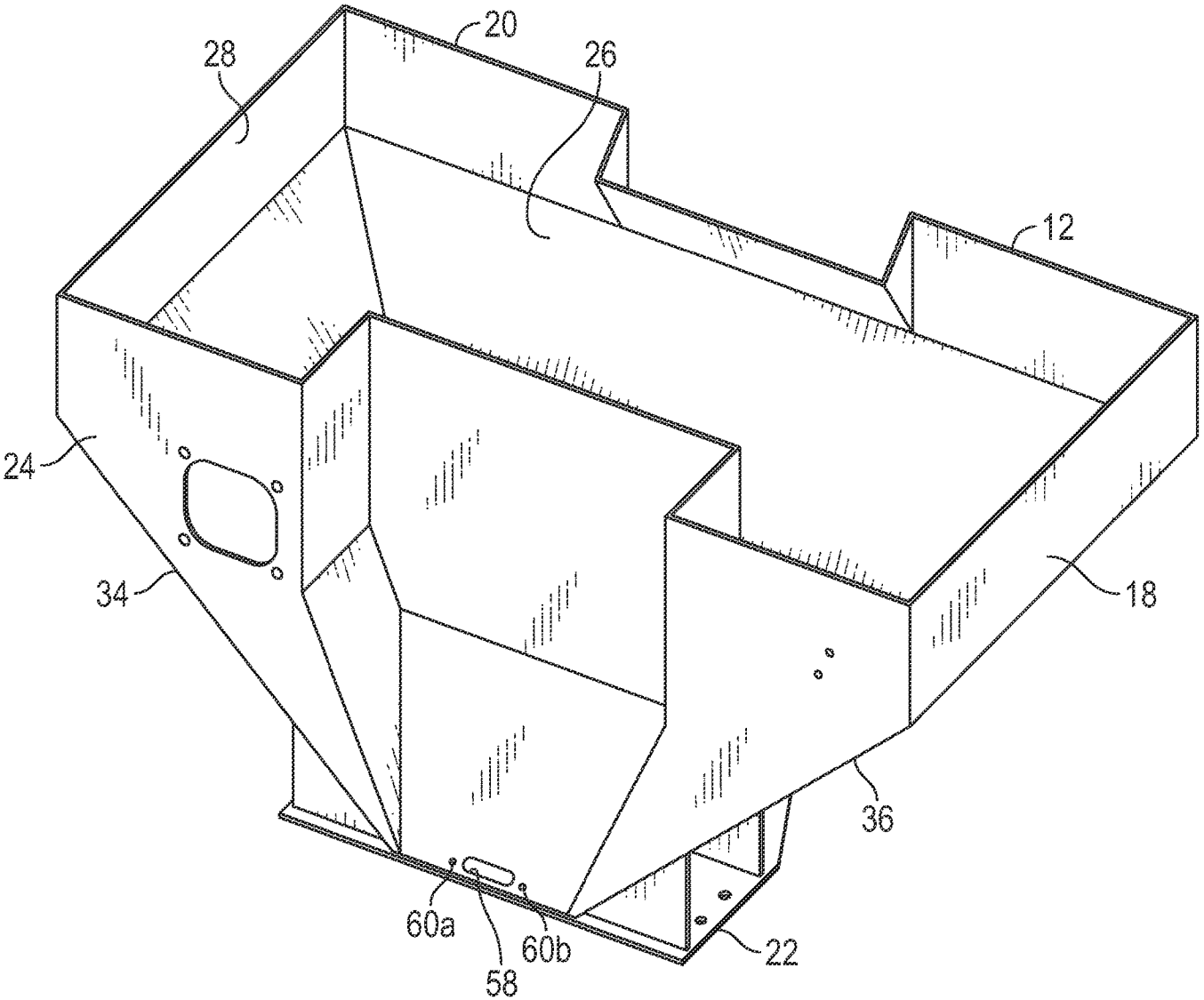
FIG. 2 illustrates a perspective view of an oilfield material reservoir constructed in accordance with implementations of various technologies and techniques described herein.
Figure 3:
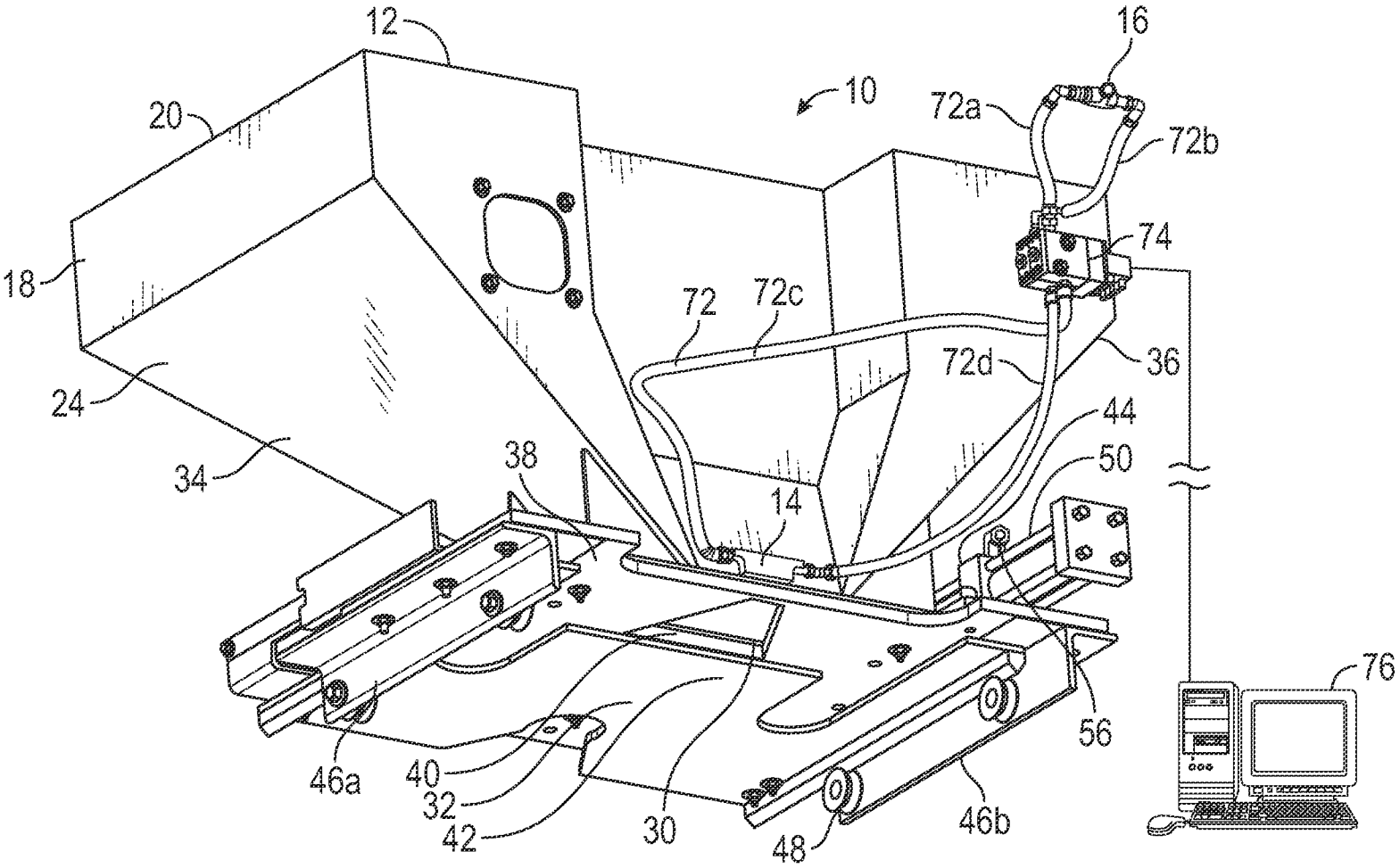
FIG. 3 illustrates a perspective view of an oilfield material metering gate obstruction removal system constructed in accordance with implementations of various technologies and techniques described herein.

Referring now to FIGS. 1-3, shown therein is an oilfield material metering gate obstruction removal system 10 (also referred to herein for purposes of conciseness as a "proppant metering gate obstruction removal system"). The proppant metering gate obstruction removal system 10 comprises an oilfield material reservoir, or proppant hopper 12, a fluid nozzle 14 positioned on the proppant hopper 12, and a fluid supplier 16 connected to the fluid nozzle 14.

For purposes of conciseness, the term "oilfield material" as used herein may include proppant, but may also include and should not be limited to, dry guar, cement, suspending agents of the type used in drilling mud, such as polymers, clays, emulsions, transition metal oxides and hyroxides, as will be appreciated by a person skilled in the art.

The term "proppant" as used herein relates to sized particles mixed with fracturing fluid to provide an efficient conduit for production of fluid from the reservoir to the wellbore. For example, the term "proppant" as used herein may include extramatrical channel-forming materials, referred to as channelant, and also may include naturally occurring sand grains or gravel, man-made or specially engineered proppants, such as resin-coated sand or high-strength ceramic materials like sintered bauxite. Proppant materials may also include fibers. The fibers can be, for example, glass, ceramics, carbon including carbon-based compounds, metal including metallic alloys, or the like, or a combination thereof, or a polymeric material such as PLA, PGA, PET, polyol, or the like, or a combination thereof.

In FIG. 1, a blending unit 15 is shown provided with two proppant metering gate obstruction removal systems boa and bob, with two proppant hoppers 12*a* and 12*b*. Each of the two proppant hoppers 12*a* and 12*b* has a body 18 configured to receive an oilfield material, such as a proppant. The body 18 has an upper end 20, a lower end 22, and a sidewall 24 extending between the upper end 20 and the lower end 22. The sidewall 24 defines a recess 26 within the body 18 of the proppant hopper 12. The upper end 20 of the body 18 defines an opening 28 for receiving the proppant, and the lower end 22 of the body 18 defines a first orifice 30 for discharging the proppant. Connected to the lower end 22 of the body 18 is a metering gate 32 which may be used to control the discharge rate of the proppant to a mixer (not shown).

The sidewall 24 of the body 18 may be configured with a first side 34 and a second side 36 which taper from the upper end 20 to the lower end 22. As shown in FIGS. 1-3, the first side 34 and second side 36 taper from substantially near the upper end 20 of the body 18 to the lower end 22 of the body 18. The tapering of the first side 34 and second side 36 may facilitate directing a flow of proppant from the opening 28, through the recess 26, to the first orifice 30. Although shown in FIGS. 1-3 with the first side 34 and second side 36 as tapering, it will be understood that one or more sides of the sidewall 24 of the body 18 may be tapered between the upper end 20 and the lower end 22 to facilitate the flow of proppant from the opening 28, through the recess 26, to the first orifice 30. The flow of proppant through the recess 26 and the first orifice 30 may be a gravity-fed flow where proppant travels through the first orifice 30 by gravity free fall to the mixer.

The first orifice 30 is defined by the lower end 22 of the body 18 and may be in the shape of a trapezoid, triangle, square, rectangle, or other polynomial. The size of the first orifice 30 may be manipulated with the metering gate 32, which is connected to the lower end 22 of the body 18 to allow for the proppant flow rate to be regulated through the first orifice 30. Regulation of the flow rate may involve the creation of a mathematical model where the proppant rate may be expressed as a function of factors representing the effects of physical proppant properties and environmental factors to achieve a desired flow rate of proppant in gravity free fall through the first orifice 30.

As shown in FIG. 3, the metering gate 32 connected to the lower end 22 of the body 18 may comprise a base 38 connected to the lower end 22 of the body 18, a second orifice 40 formed within the base 38, a knife gate 42 connected to the base 38 and configured to slidably cover the first and second orifices 30 and 40, respectively, and an actuator 44 connected to the base 38 and the knife gate 42 configured to cause the knife gate 42 to slidably cover the first and second orifices 30 and 40. The second orifice 40, formed within the base 38, may be substantially trapezoidal in shape and overlaps the first orifice 30 of the body 18 of the proppant hopper 12, such that when the knife gate 42 slidably covers the second orifice 40, the knife gate 42 also slidably covers the first orifice 30. The base 38 may be connected to the lower end 22 by brazing, welding, bolting, or any other suitable means of connection. The knife gate 42 may be connected to the base 38 by brackets 46*a* and 46*b*, as shown in FIG. 3, with a plurality of rollers 48. The knife gate 42 may be mounted between the brackets 46*a* and 46*b* and between the plurality of rollers 48 and the base 38, so as to secure the knife gate 42 against the base 38. The knife gate 42, mounted between the plurality of rollers 48 and the base 38 may then move beneath the base 38 so as to slidably cover the first and second orifices 30 and 40. The actuator 44 may be mechanically connected to the base 38 and the knife gate 42 via any suitable method such that the actuator 44 may articulate the knife gate 42 between completely covering the first and second orifices 30 and 40, completely uncovering the first and second orifices 30 and 40, and any level of partial coverage therebetween.

The actuator 44 may be implemented as a pneumatic cylinder, hydraulic cylinder, electric cylinder, or any other actuator 44 suitable to cause the knife gate 42 to slidably cover the first and second orifices 30 and 40. As shown in FIGS. 1 and 3, the actuator 44 may be implemented as a hydraulic cylinder connected to the base 38 by a housing 50 and connected to the knife gate 42 at a piston head 52. The actuator 44 may articulate the knife gate 42 between open, close, and intermittent positions of closure of the first and second orifices 30 and 40 by extending or retracting a piston 54. Extending and retracting the piston 54 of the actuator 44 may be performed by sending electrical signals through a control unit 56 electrically connected to a computer, processor, controller, or other electronic device capable of sending and receiving data indicative of instructions for articulating the knife gate 42.

The proppant hopper 12 may have an opening 58 formed within the sidewall 24 substantially near the lower end 22 of the body 18. The opening 58 may be centered with respect to the first orifice 30 such that the opening 58 is aligned on the sidewall 24 with the center of the first orifice 30 and adjacent to one side of the first orifice 30. The proppant hopper 12 may also be provided with holes 60*a* and 60*b* to connect the fluid nozzle 14 to the sidewall 24 of the proppant hopper 12.

Figure 4:
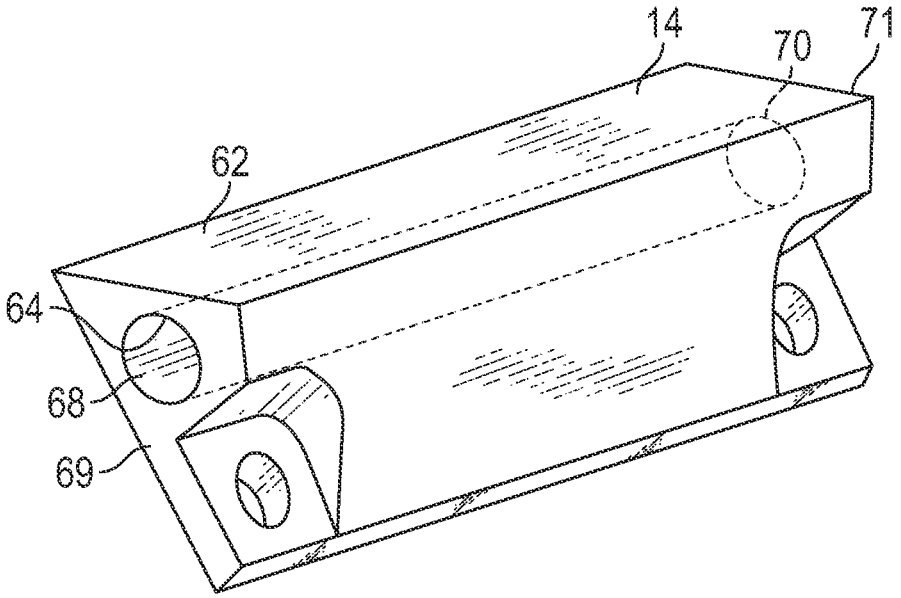
FIG. 4 illustrates a perspective view of a fluid nozzle of the oilfield material metering gate obstruction removal system, constructed in accordance with implementations of various technologies and techniques described herein.
Figure 5:
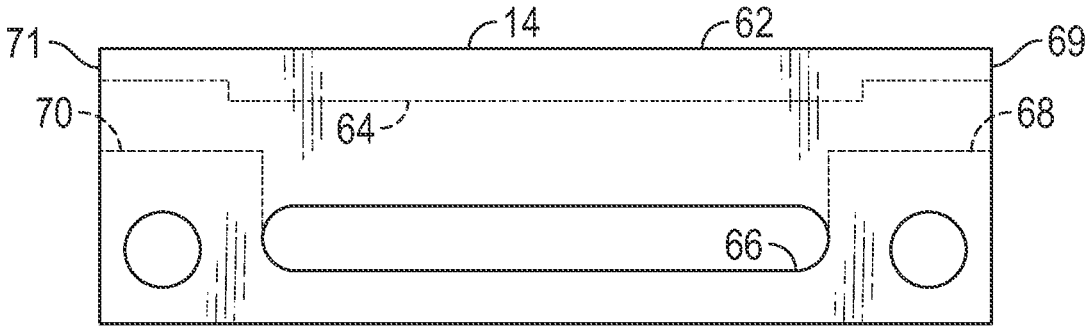
FIG. 5 illustrates a bottom plan view of the fluid nozzle of FIG. 4.

Referring now to FIGS. 3-5, the proppant metering gate obstruction removal system 10, provided with the proppant hopper 12, previously described, is also provided with the fluid nozzle 14 and the fluid supplier 16. The fluid nozzle 14 may comprise one or more members 62 connected together. In the example shown, the member 62 is solid and is provided with a through hole 64 and a slot 66 or fluid outlet. The through hole 64 is configured within the member 62 to define a first inlet 68 on a first side 69 and a second inlet 70 on a second side 71, opposite the first side 69. As shown in FIGS. 4-5, the first inlet 68 may be disposed on a left side of the fluid nozzle 14 and the second inlet 70 may be disposed on a right side of the fluid nozzle 14 opposite the first inlet 68. The slot 66 may be formed in a central portion of the member 62 to intersect with the through hole 64. The fluid nozzle 14 may be mounted to the sidewall 24 of the proppant hopper 12 in such a manner that the slot or fluid outlet 66 corresponds to the opening 58. The fluid nozzle 14 may be mounted to the sidewall 24 via the holes 60*a* and 60*b*, causing fluid passing through the fluid nozzle 14 to pass through the fluid outlet 66 and the opening 58 and be directed through the first and second orifices 30 and 40.

The fluid supplier 16 is connected to the first inlet 68 and the second inlet 70 of the fluid nozzle 14 via tubing 72 and an electromechanical control valve 74. The electromechanical control valve 74 may be mounted to the sidewall 24 of the proppant hopper 12 in any suitable manner such as by using nuts and bolts. The tubing 72 may be provided as rigid piping, flexible piping or hose, or any other suitable tubing capable of providing fluid communication between the fluid supplier 16 and the fluid nozzle 14. The fluid supplier 16 may be connected to the electromechanical control valve 74 via tubing 72*a* and 72*b*, with the electromechanical control valve 74 connected to the fluid nozzle 14 via tubing 72*c* and 72*d*. The tubing 72*c* and 72*d* may be connected to the first inlet 68 and second inlet 70 respectively, placing the fluid supplier 16 in fluid communication with the fluid nozzle 14 via the tubing 72 and the electromechanical control valve 74. The fluid communication between the fluid supplier 16 and the fluid nozzle 14 thereby places the first and second orifices 30 and 40 in fluid communication with the fluid supplier 16 via the recess 26 through the opening 58 and the fluid nozzle 14.

The proppant metering gate obstruction removal system 10, as shown in FIG. 3, may also be provided with an automatic control unit 76, such as a computer, that regulates at least one parameter of a fluid flow through the fluid nozzle 14. The at least one parameter of the fluid flow may be selected from the group comprising fluid duration, fluid frequency, and fluid directional sequencing. The automatic control unit 76 may be implemented as computer executable instructions stored on a non-transitory computer readable medium that when executed by one or more processors causes the one or more processor to direct control signals to the electromechanical control valve 74.

The computer may include one or more processor, one or more non-transitory computer readable medium, one or more input devices, and one or more output devices. The one or more processor may be implemented as a single processor or multiple processors working together to execute computer executable instructions. Exemplary embodiments of the one or more processors include a digital signal processor, a central processing unit, a microprocessor, a multi-core processor, and combinations thereof. The one or more processor may be coupled to the one or more non-transitory computer readable medium and capable of communicating with the one or more non-transitory computer readable medium via a path, which may be implemented as a data bus, for example. The one or more processor may be capable of communicating with an input device and an output device via paths similar to the path described above coupling the one or more processor to the one or more non-transitory computer readable medium. The one or more processor is further capable of interfacing and/or communicating with one or more networks via a communications device such as by exchanging electronic, digital, and/or optical signals via the communications device using a network protocol such as TCP/IP. It is to be understood that in certain embodiments using more than one processor, the one or more processor may be located remotely from one another, locating in the same location, or comprising a unitary multicore processor. The one or more processor is capable of reading and/or executing computer executable instructions and/or creating, manipulating, altering, and storing computer data structures into the one or more non-transitory computer readable medium.

The one or more non-transitory computer readable medium stores computer executable instructions and may be implemented as any conventional non-transitory computer readable medium, such as random access memory (RAM), a hard drive, a DVD-ROM, a BLU-RAY, a floppy disk, an optical drive, and combinations thereof. When more than one non-transitory computer readable medium is used one or more non-transitory computer readable medium may be located in the same physical location as the one or more processor, and one or more non-transitory computer readable medium may be located in a remote physical location from the one or more processor. The physical location of the one or more non-transitory computer readable medium can be varied, and one or more non-transitory computer readable medium may be implemented as a "cloud memory," i.e. one or more non-transitory computer readable medium which is partially, or completely based on or accessed using the network, so long as at least one of the one or more non-transitory computer readable medium is located local to the one or more processor.

The computer executable instructions stored on the one or more non-transitory computer readable medium may comprise logic representing the at least one parameter of a fluid flow through the fluid nozzle 14. The computer may cause the fluid supplier 16 and electromechanical control valve 74 to inject compressed fluid into the first and second orifices 30 and 40 in order to selectively apply fluid to obstructions or clogs located at varying points in the first and second orifices 30 and 40.

The fluid nozzle 14 may be mounted to the proppant hopper 12 via bolts, brazing, welding, or any other suitable connection method. Fluid may be supplied through the fluid supplier 16 and through the fluid nozzle 14 via the tubing 72 and the electromechanical control valve 74. The fluid supplied through the fluid supplier 16 and fluid nozzle 14 via the tubing 72 may be air, a gas, a liquid, compressed air, a compressed gas, or any other suitable fluid capable of being supplied through the fluid supplier 16 and fluid nozzle 14 to remove an obstruction or clog within the first orifice 30 and/or second orifice 40. Direction of the fluid through the fluid nozzle 14 may be controlled and used to remove a clog formed in the proppant hopper 12 at the first orifice 30 and/or the second orifice 40.

Figure 6:
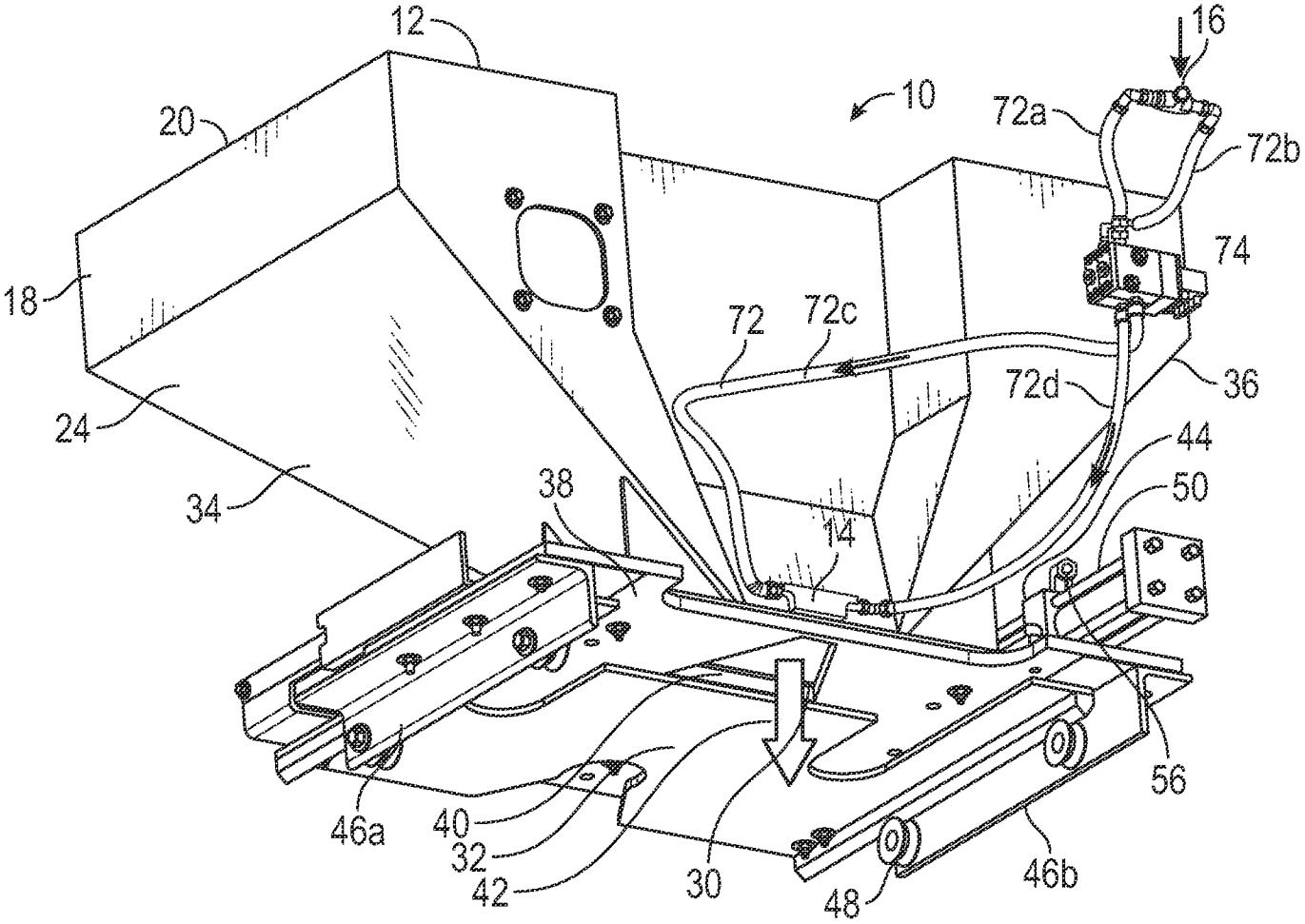
FIG. 6 illustrates a schematic view of the oilfield material metering gate obstruction removal system of FIG. 3 in operation.
Figure 7:
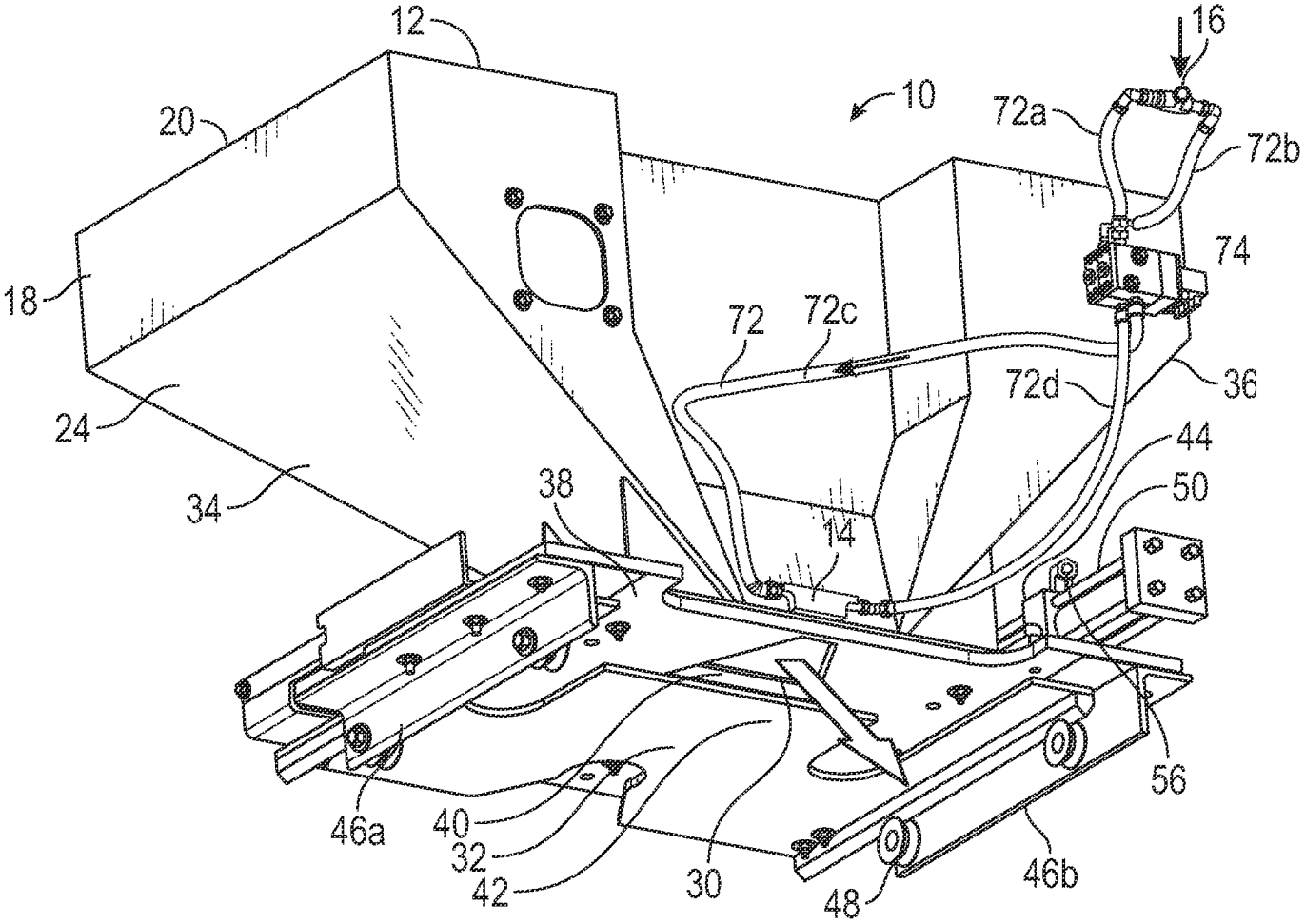
FIG. 7 illustrates another schematic view of the oilfield material metering gate obstruction removal system of FIG. 3 in operation.
Figure 8:
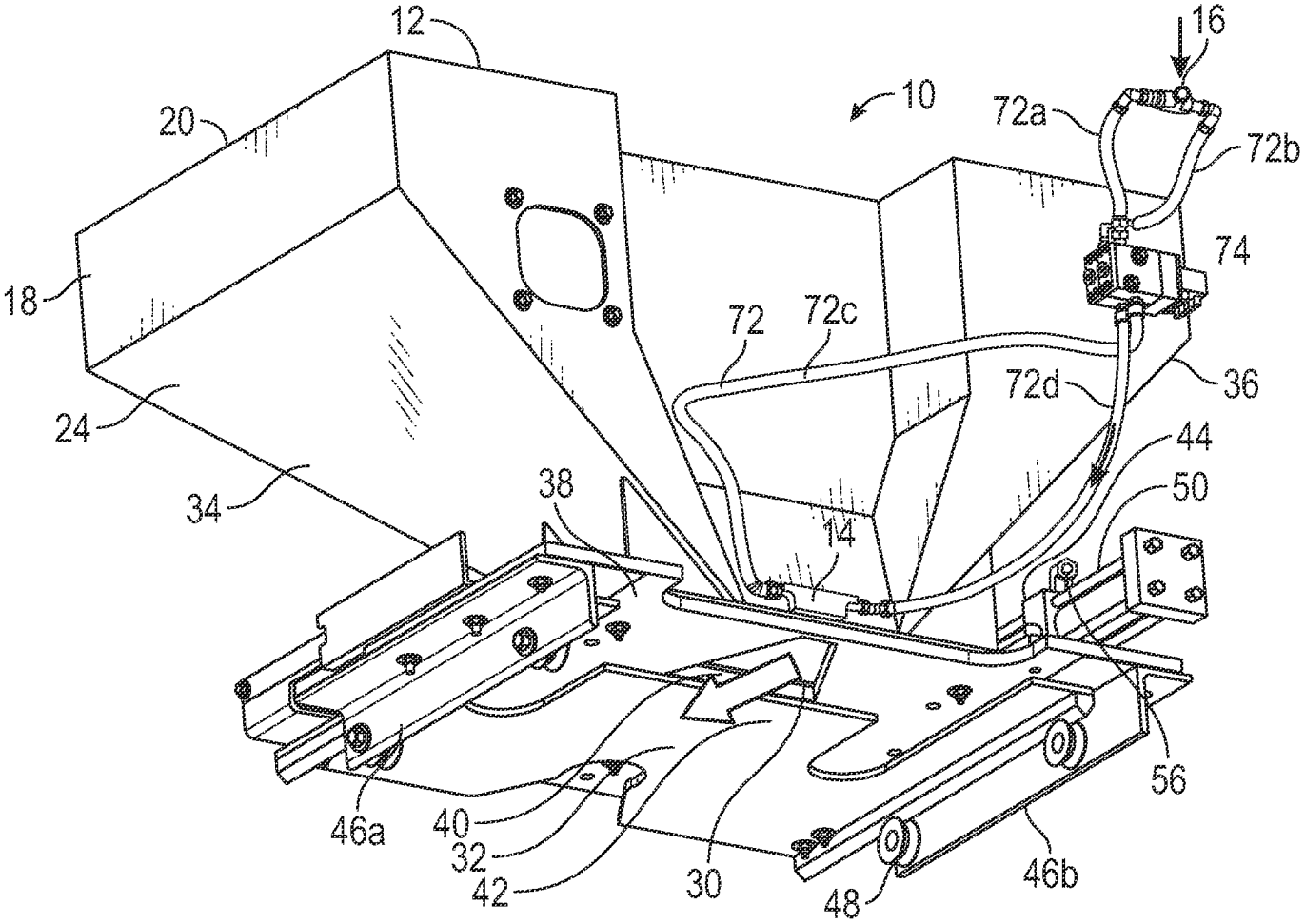
FIG. 8 illustrates another schematic view of the oilfield material metering gate obstruction removal system of FIG. 3 in operation.

The proppant metering gate obstruction removal system 10, in operation, receives a proppant into the proppant hopper 12 through the opening 28 and discharges the proppant through the first and second orifices 30 and 40. As shown in FIGS. 6-8, in the event of a clog at the first and second orifices 30 and 40, fluid may be supplied through the fluid supplier 16 and through tubing 72*a* and 72*b*, passing into 72*c* and 72*d*, and injecting fluid through both the first inlet 68 and second inlet 70. The fluid may also be supplied through the fluid supplier 16 and through either tubing 72*c* or 72*d* in order to inject fluid through either the first inlet 68 or the second inlet 70. The fluid therefore may be directed through the first inlet 68, the second inlet 70, or both simultaneously in order to direct the fluid flow injected into the recess 26 through the first and second orifices 30 and 40 in differing directions so as to remove one or more clogs from varying locations within the orifice.

As shown in FIG. 6, when fluid is injected through the first inlet 68 and the second inlet 70 simultaneously, a central blast of fluid is directed downwards through the first and second orifices 30 and 40. This may enable the clearing of an obstruction or clog located centrally in the first and second orifices 30 and 40. As shown in FIGS. 7 and 8, when fluid enters only the first inlet 68 or second inlet 70, the resulting fluid blast is directed towards the edge of the first and second orifices 30 and 40 opposite the first inlet 68 or second inlet 70, whichever is in use at the time. This may enable the clearing of an obstruction or clog in one or more corners or at one or more sides of the first and second orifices 30 and 40. The automatic control unit 76 may be programmed to perform fluid blasts based on manual input from a user or may be programmed to provide a predetermined pattern of fluid blasts. For example, one pattern may be three fluid blasts on the right followed by three fluid blasts on the left followed by two central fluid blasts. Of course, one skilled in the art will recognize that other patterns for clearing clogs may be used.

The preceding description has been presented with reference to some embodiments. Persons skilled in the art and technology to which this disclosure pertains will appreciate that alterations and changes in the described structures and methods of operation can be practiced without meaningfully departing from the principle, and scope of this application. Accordingly, the foregoing description should not be read as pertaining only to the precise structures described and shown in the accompanying drawings, but rather should be read as consistent with and as support for the following claims, which are to have their fullest and fairest scope.

What is claimed is:

1. A system, comprising an oilfield material reservoir having a body and defining a first opening for receiving an oilfield material and defining an orifice within the body for discharging the oilfield material; a fluid nozzle defining a first inlet on a first end and a second inlet on a second end and a fluid outlet between the first end and second end, the outlet of the fluid nozzle positioned adjacent the orifice within the body to direct a fluid flow from the fluid outlet and through the orifice; wherein the fluid nozzle comprises a solid member that comprises: a through hole configured therein to define the first inlet on the first end and the second inlet on the second end; and a slot configured around a central portion of the solid member and intersecting with the through hole and defining the fluid outlet; a fluid supplier connected to each of the first inlet and the second inlet of the fluid nozzle; and an electromechanical valve disposed between the fluid supplier and each of the first inlet and the second inlet of the fluid nozzle, the valve configured to selectively direct fluid flow from the valve to one of each of the first inlet, the second inlet, and both of the first inlet and the second inlet simultaneously.

2. The system of claim 1, wherein the fluid nozzle is mounted to the oilfield material reservoir in such a manner that the slot of the fluid nozzle corresponds to a second opening formed within the oilfield material reservoir.

3. The system of claim 1, further comprising an automatic control computer unit that regulates at least one parameter of the fluid flow through the fluid nozzle.

4. The system of claim 3, wherein said at least one parameter is selected from a group consisting of fluid duration, fluid frequency, and fluid directional sequencing.

5. The system of claim 3, wherein the automatic control computer unit is a computer executable instruction.

6. The system of claim 3, wherein the automatic control computer unit is programmable to perform fluid blasts through at least one of the first and second inlets to clear an obstruction in the orifice.

* * * * *